US007141929B2

(12) United States Patent
Tachibana et al.

(10) Patent No.: US 7,141,929 B2
(45) Date of Patent: Nov. 28, 2006

(54) PLASMA DISPLAY PANEL WITH PRIMING ELECTRODE

(75) Inventors: Hiroyuki Tachibana, Suita (JP); Naoki Kosugi, Kyoto (JP); Tsuyoshi Nishio, Mino (JP); Masaki Nishimura, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/505,481

(22) PCT Filed: Mar. 25, 2004

(86) PCT No.: PCT/JP2004/004141

§ 371 (c)(1),
(2), (4) Date: Aug. 23, 2004

(87) PCT Pub. No.: WO2004/086446

PCT Pub. Date: Oct. 7, 2004

(65) Prior Publication Data

US 2005/0146274 A1 Jul. 7, 2005

(30) Foreign Application Priority Data

Mar. 27, 2003 (JP) ..... 2003-088460

(51) Int. Cl.
*H01J 17/49* (2006.01)
*H01J 9/00* (2006.01)

(52) U.S. Cl. ..... 313/583; 313/584; 313/585; 313/586; 445/24

(58) Field of Classification Search ..... 313/582–524
See application file for complete search history.

(56) References Cited

U.S. PATENT DOCUMENTS

| | | | | |
|---|---|---|---|---|
| 5,661,500 | A * | 8/1997 | Shinoda et al. | 345/60 |
| 6,313,580 | B1 * | 11/2001 | Makino | 313/582 |
| 6,674,238 | B1 * | 1/2004 | Otani et al. | 313/587 |
| 2001/0048275 | A1 * | 12/2001 | Nakada et al. | 315/160 |
| 2003/0011307 | A1 * | 1/2003 | Otani et al. | 313/582 |
| 2005/0104807 | A1 * | 5/2005 | Tachibana et al. | 345/60 |
| 2005/0156524 | A1 * | 7/2005 | Tachibana et al. | 313/586 |

FOREIGN PATENT DOCUMENTS

| | | |
|---|---|---|
| JP | 08-162019 | 6/1996 |
| JP | 08-335440 | 12/1996 |
| JP | 10-283941 | 10/1998 |
| JP | 11-297211 | 10/1999 |
| JP | 2000-268716 | 9/2000 |
| JP | 2001-195990 | 7/2001 |
| JP | 2002-297091 | 10/2002 |

* cited by examiner

*Primary Examiner*—Nimeshkumar D. Patel
*Assistant Examiner*—Peter Macchiarolo
(74) *Attorney, Agent, or Firm*—Steptoe & Johnson LLP

(57) ABSTRACT

A plasma display panel to stabilize address properties. A front substrate (1) and a back substrate (2) face each other, to form a discharge space (3) which is partitioned by barrier ribs (11) to form priming discharge cells (16) and main discharge cells (12). A dielectric layer (17) is formed on the back substrate (2) on which the priming discharge cell (16) is present. Insulation is ensured between a data electrode (10) and the priming electrode (15) because the latter is formed on the dielectric layer (17). One is able to generate a priming discharge before a main discharge.

7 Claims, 9 Drawing Sheets

PLASMA DISPLAY PANEL WITH PRIMING ELECTRODE

TECHNICAL FIELD

The present invention relates to plasma display panels used for wall-hung TVs and large-size monitors.

BACKGROUND ART

An AC surface discharge type plasma display panel (hereinafter referred to as PDP), which is a typical AC type PDP, is formed of a front plate made of a glass substrate having scan electrodes and sustain electrodes provided thereon for a surface discharge, and a back plate made of a glass substrate having data electrodes provided thereon. The front plate and the back plate are disposed to face each other in parallel in such a manner that the electrodes on both plates form a matrix, and that a discharge space is formed between the plates. And the outer part of the plates thus combined is sealed with a sealing member such as a glass frit. Between the substrates, discharge cells partitioned by barrier ribs are formed, and phosphor layers are provided in the cell spaces formed by the barrier ribs. In a PDP with this structure, ultraviolet rays are generated by gas discharge and used to excite and illuminate phosphors for red, green and blue, thereby performing a color display (See Japanese Laid-Open Patent Application No. 2001-195990).

In this PDP, one field period is divided into a plurality of sub fields, and sub fields during which to illuminate phosphors are combined so as to drive the PDP for a gradation display. Each sub field consists of an initialization period, an address period and a sustain period. For displaying image data, each electrode is applied with signals different in waveform between the initialization, address and sustain periods.

In the initialization period, all scan electrodes are applied with, e.g. a positive pulse voltage so as to accumulate a necessary wall charge on a protective film provided on a dielectric layer covering the scan electrodes and the sustain electrodes, and also on the phosphor layers.

In the address period, all scan electrodes are scanned by being sequentially applied with a negative scan pulse, and when there are display data, a positive data pulse is applied to the data electrodes while the scan electrodes are being scanned. As a result, a discharge occurs between the scan electrodes and the data electrodes, thereby forming a wall charge on the surface of the protective film provided on the scan electrodes.

In the subsequent sustain period, for a set period of time, a voltage enough to sustain a discharge is applied between the scan electrodes and the sustain electrodes. This voltage application generates a discharge plasma between the scan electrodes and the sustain electrodes, thereby exciting and illuminating phosphor layers for a set period of time. In a discharge space where no data pulse has been applied during the address period, no discharge occurs, causing no excitation or illumination of the phosphor layers.

In this type of PDP, a large delay in discharge occurs during the address period, thereby making the address operation unstable, or completion of the address operation requires a long address time, thereby spending too much time for the address period. In an attempt to solve these problems, there have been provided a PDP in which auxiliary discharge electrodes are formed on a front plate, and a discharge delay is reduced by a priming discharge generated by an in-plane auxiliary discharge on the front plate side, and a method for driving the PDP (See Japanese Laid-Open Patent Application No. 2002-297091).

However, in these conventional PDPs, when the number of lines is increased as a result of achieved higher definition, more time must be spent for the address time and less time must be spent for the sustain period, thereby making it difficult to secure the brightness when higher definition is achieved. Furthermore, when the partial pressure of xenon (Xe) is increased to achieve higher brightness and higher efficiency, a discharge initiation voltage rises so as to increase a discharge delay, thereby deteriorating address properties. Since the address properties are greatly affected by the address process, it is demanded to reduce a discharge delay during the addressing, thereby accelerating the address time.

In spite of this demand, in conventional PDPs having a priming discharge in the front plate surface, the discharge delay during the addressing cannot be reduced sufficiently; the operation margin of an auxiliary discharge is small; and a false discharge is induced to make the operation unstable. Moreover, since the auxiliary discharge is performed in the front plate surface, more priming particles than necessary for priming are applied to an adjacent discharge cell, thereby causing crosstalk.

The present invention, which has been contrived in view of the aforementioned problems, has an object of providing a PDP for performing a priming discharge between the front plate and the back plate to stably generate a priming discharge, thereby having stable address properties even when higher definition is achieved, and also providing a method for manufacturing the PDP.

SUMMARY OF THE INVENTION

In order to achieve the object, a PDP of the present invention comprises: a first electrode and a second electrode which are disposed in parallel with each other on a first substrate; a third electrode disposed on a second substrate in a direction orthogonal to the first electrode and the second electrode, the second substrate being disposed to face the first substrate with a discharge space therebetween; a fourth electrode disposed on the second substrate in such a manner as to be parallel with the first electrode and the second electrode; and a first discharge space and a second discharge space which are formed on the second substrate by being partitioned by a barrier rib, wherein a main discharge cell for performing a discharge with the first electrode, the second electrode and the third electrode is formed in the first discharge space, and a priming discharge cell for performing a discharge with the fourth electrode and at least one of the first electrode and the second electrode is formed in the second discharge space, and in the second discharge space, the fourth electrode is formed on a dielectric layer and is disposed closer to the first electrode and the second electrode than the third electrode.

According to this structure, in the second discharge space, the fourth electrode is formed on the dielectric layer, that is, the third electrode and the fourth electrode are isolated from each other via the dielectric layer so as to secure the isolation voltage between both electrodes.

Furthermore, the dielectric layer makes the discharge distance in the second discharge space where the priming discharge is performed shorter than the discharge distance in the first discharge space where the main discharge is performed, so that the priming discharge in the second discharge space can be securely performed prior to the address discharge, which is the main discharge, in the first discharge space. As a result, a PDP with excellent address properties can be achieved.

DETAILED DESCRIPTION OF PREFERRED EMBODIMENTS

A PDP according to an embodiment of the present invention will be described as follows with reference to accompanying drawings.

First Exemplary Embodiment

Figure 1:
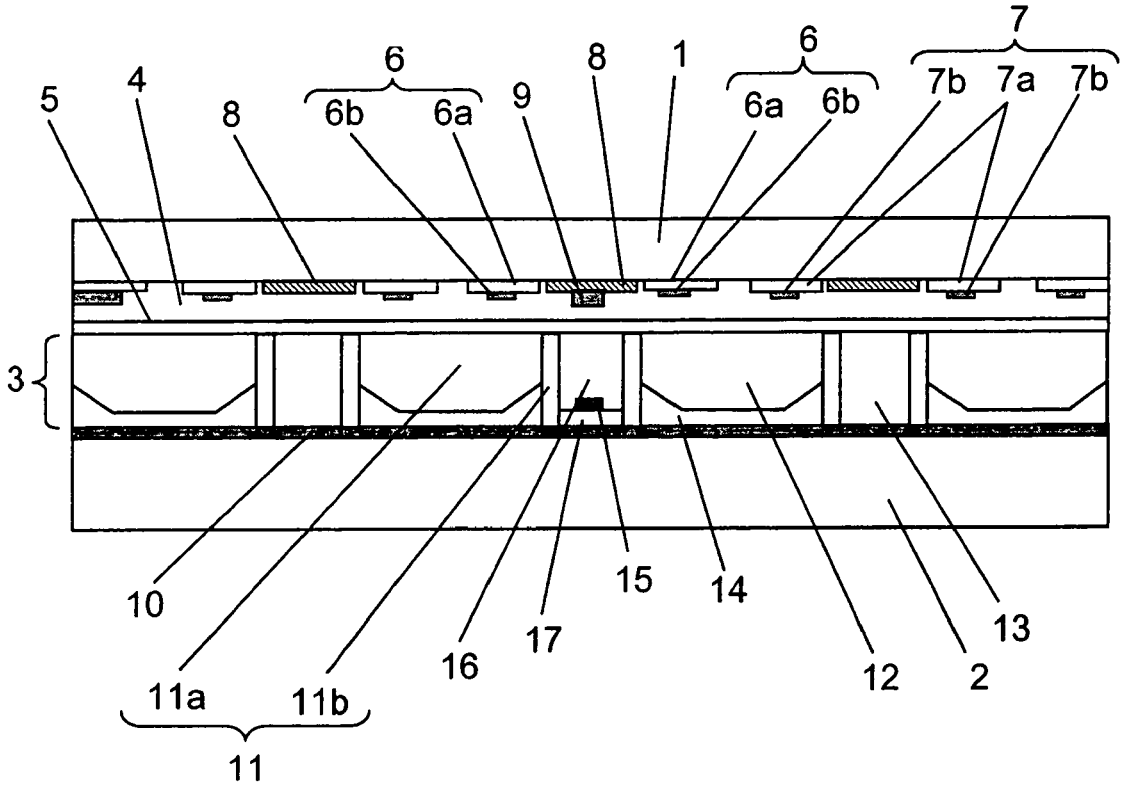
FIG. 1 is a cross sectional view of a PDP according to a first embodiment of the present invention.
Figure 2:
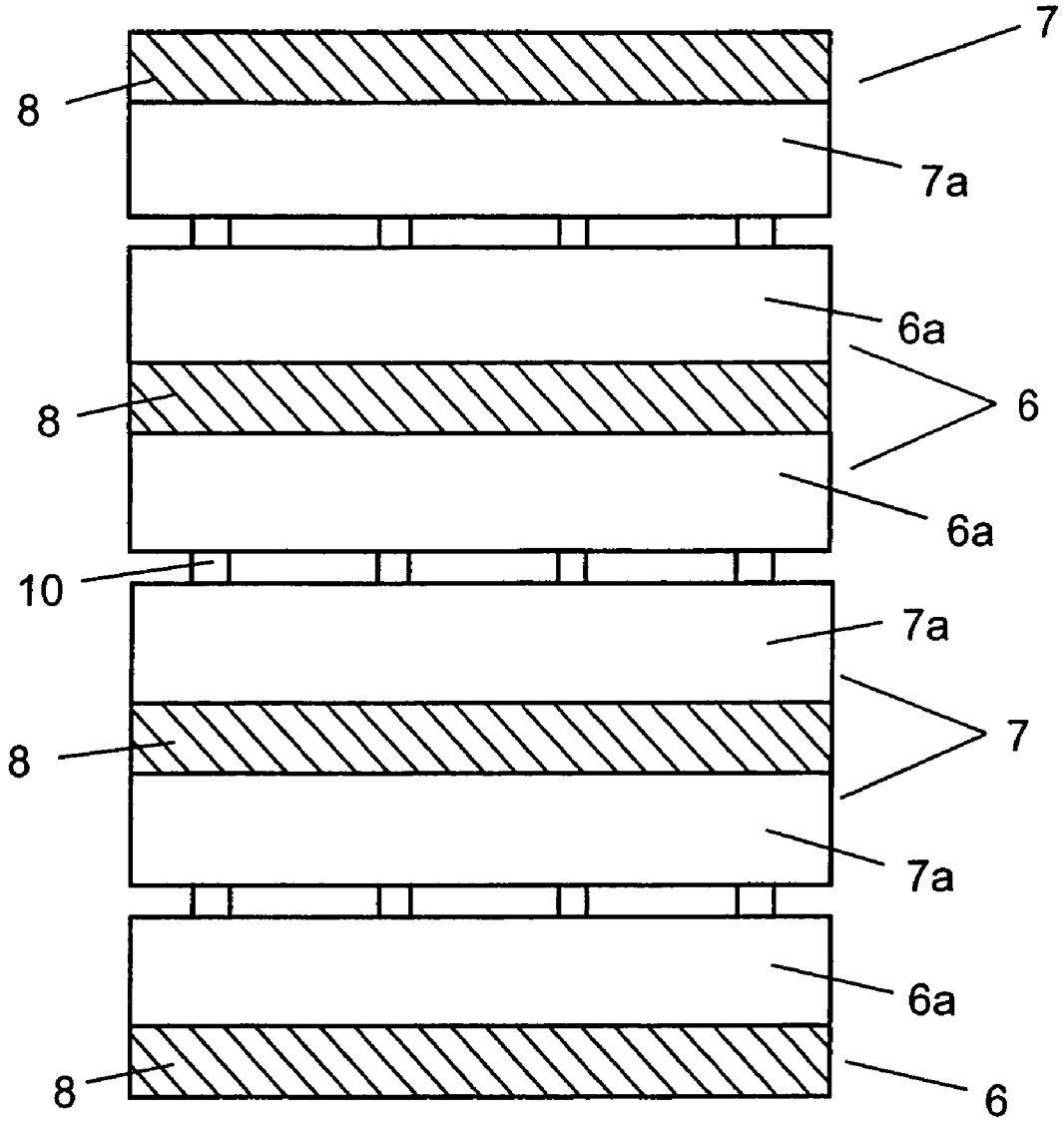
FIG. 2 is a schematic plan view showing an electrode arrangement on a front substrate side of the PDP according to the first embodiment of the present invention.
Figure 3:
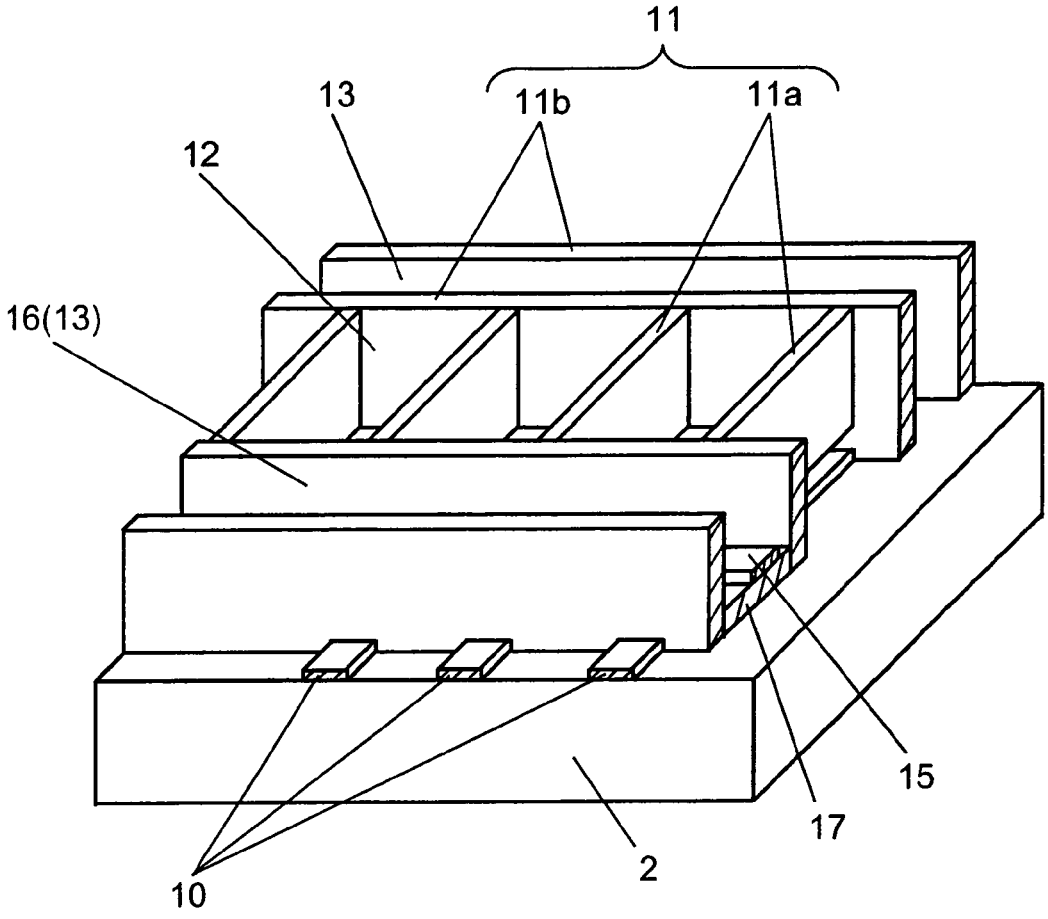
FIG. 3 is a schematic perspective view showing a back substrate side of the PDP according to the first embodiment of the present invention.

FIG. 1 is a cross sectional view of a PDP according to a first embodiment of the present invention, FIG. 2 is a schematic plan view showing an electrode arrangement on a front substrate side, which is a first substrate side and FIG. 3 is a schematic perspective view showing a back substrate side, which is a second substrate side.

As shown in FIG. 1, front substrate 1 which is a first substrate made of glass, and back substrate 2 which is a second substrate made of glass are disposed to face each other with discharge space 3 therebetween, and discharge space 3 is sealed with neon, xenon (Xe) and the like as gasses for irradiating ultraviolet rays by discharge. On front substrate 1, a group of belt-shaped electrodes consisting of pairs of scan electrodes 6 as first electrodes and sustain electrodes 7 as second electrodes are disposed in parallel with each other in such a manner as to be covered with front plate dielectric layer 4 and protective layer 5. Scan electrodes 6 and sustain electrodes 7 are respectively formed of transparent electrodes 6*a* and 7*a*, and metal bus bars 6*b* and 7*b*, which are respectively laid on transparent electrodes 6*a* and 7*b*, and which are made of silver or the like for improving conductivity. As shown in FIGS. 1 and 2, scan electrodes 6 and sustain electrodes 7 are disposed alternately, two by two, so that scan electrode 6-scan electrode 6-sustain electrode 7-sustain electrode 7, . . . are arranged in that order, and light absorption layers 8 for improving a contrast at the time of illumination are each disposed between two adjacent sustain electrodes 7, and between two adjacent scan electrodes 6. In addition, auxiliary electrodes 9 are provided on light absorption layer 8 disposed between adjacent scan electrodes 6, and are connected with one of scan electrodes 6 adjacent to each other at a non-display part (end part) of the PDP.

As shown in FIGS. 1 and 3, back substrate 2 is provided thereon with a plurality of belt-shaped data electrodes 10 which are third electrodes disposed in parallel with each other in the direction orthogonal to scan electrodes 6 and sustain electrode 7. Back substrate 2 is also provided thereon with barrier ribs 11 for partitioning a plurality of discharge cells formed by scan electrodes 6, sustain electrodes 7 and data electrodes 10. Barrier ribs 11 are formed of longitudinal rib parts 11*a* extending in the direction orthogonal to scan electrodes 6 and sustain electrodes 7 provided on front substrate 1, namely in the direction parallel to data electrodes 10, and of lateral rib parts 11*b* crossing longitudinal rib parts 11*a* to form main discharge cells 12 which are first discharge spaces, and also to form gap parts 13 between main discharge cells 12. Main discharge cells 12 are provided with phosphor layers 14 so as to form discharge cells.

As shown in FIG. 3, gap parts 13 formed on back substrate 2 are continuous in the direction orthogonal to data electrodes 10. And priming electrodes 15 which are fourth electrodes for causing a discharge between front substrate 1 and back substrate 2 are disposed, in the direction orthogonal to data electrodes 10, exclusively in gap parts 13 corresponding to regions where scan electrodes 6 are adjacent to each other, so as to form priming discharge cells 16 which are second discharge spaces. In priming discharge cells 16, data electrodes 10 are covered with dielectric layer 17, and priming electrodes 15 are formed on dielectric layer 17. Thus, priming electrodes 15 are disposed closer to protective film 5 provided on front substrate 1 than data electrodes 10, so that the discharge distance of priming discharge cells 16 can be shorter just by the thickness of dielectric layer 17 than the discharge distance of main discharge cells 12 between front substrate 1 and data electrodes 10.

Figure 4:
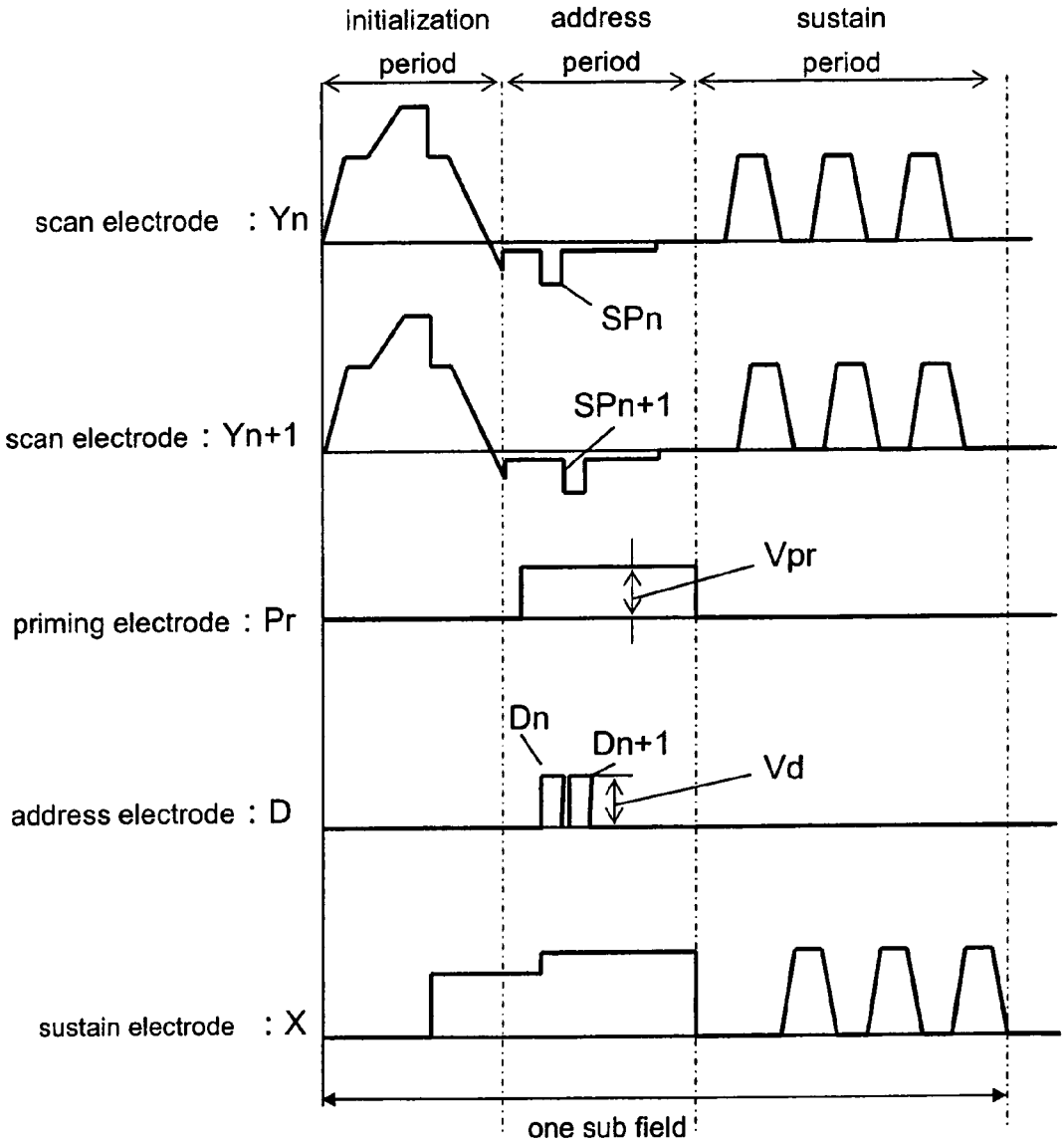
FIG. 4 is a waveform chart showing an example of waveforms for driving the PDP according to the first embodiment of the present invention.

A method for displaying image data on the PDP will be described as follows. In order to drive the PDP, one field period is divided into a plurality of sub fields having a weight of an, illumination period based on the binary system, and a gradation display is performed by a combination of sub fields during which to illuminate phosphors. Each sub field consists of an initialization period, an address period and a sustain period. FIG. 4 is a waveform chart showing an example of waveforms for driving the PDP according to the present invention. First of all, during the initialization period, in a priming discharge cell (priming discharge cell 16 shown in FIG. 1) having priming electrode Pr (priming electrode 15 shown in FIG. 1), all scan electrodes Y (scan electrodes 6 shown in FIG. 1) are applied with a positive pulse voltage so as to perform an initialization between an auxiliary electrode (auxiliary electrode 9 shown in FIG. 1) and priming electrode Pr. During the subsequent address period, priming electrode Pr is constantly applied with a positive potential. Consequently, in the priming discharge cell, when scan electrode $Y_n$ is applied with a scan pulse $SP_n$, a priming discharge occurs between priming electrode Pr and the auxiliary electrode, thereby supplying main discharge cell (main discharge cell 12 shown in FIG.

1) with priming particles. Then, scan electrode $Y_{n+1}$ of the n+1th main discharge cell is applied with a scan pulse $SP_{n+1}$; however, since a priming discharge has occurred immediately before this and priming particles have been already supplied, a discharge delay in the next addressing can be reduced. Although the driving sequence in one sub field has been described hereinbefore, the other sub fields have the same operation principle. In the drive waveforms shown in FIG. 4, applying a positive voltage to priming electrode Pr during the address period can perform the aforementioned operations more securely. The voltage to be applied to priming electrode Pr during the address period is preferably set at a larger value than the data voltage value to be applied to data electrode D.

As described hereinbefore, in the present embodiment, since priming electrodes 15 are formed on dielectric layer 17 in priming discharge cells 16, the isolation voltage between data electrodes 10 and priming electrodes 15 can be secured by dielectric layer 17, thereby stabilizing a priming discharge and an address discharge. Furthermore, the provision of dielectric layer 17 in priming discharge cells 16 makes the discharge spaces of priming discharge cells 16 have a smaller height than the discharge spaces of main discharge cells 12. Hence, the priming discharge in main discharge cells 12 corresponding to scan electrodes 6 that are connected with auxiliary electrodes 9 can be generated securely and stably prior to the address discharge in main discharge cells 12, thereby reducing a discharge delay in main discharge cells 12.

Furthermore, in the present embodiment, dielectric layer 17 is provided exclusively in priming discharge cells 16, so that the material property value and dimension value of dielectric layer 17 can be arbitrarily set. As a result, the design and manufacture satisfying both the stabilization of the main discharge operation and priming discharge operation and isolation voltage properties can be easily achieved.

Second Exemplary Embodiment

Figure 5:
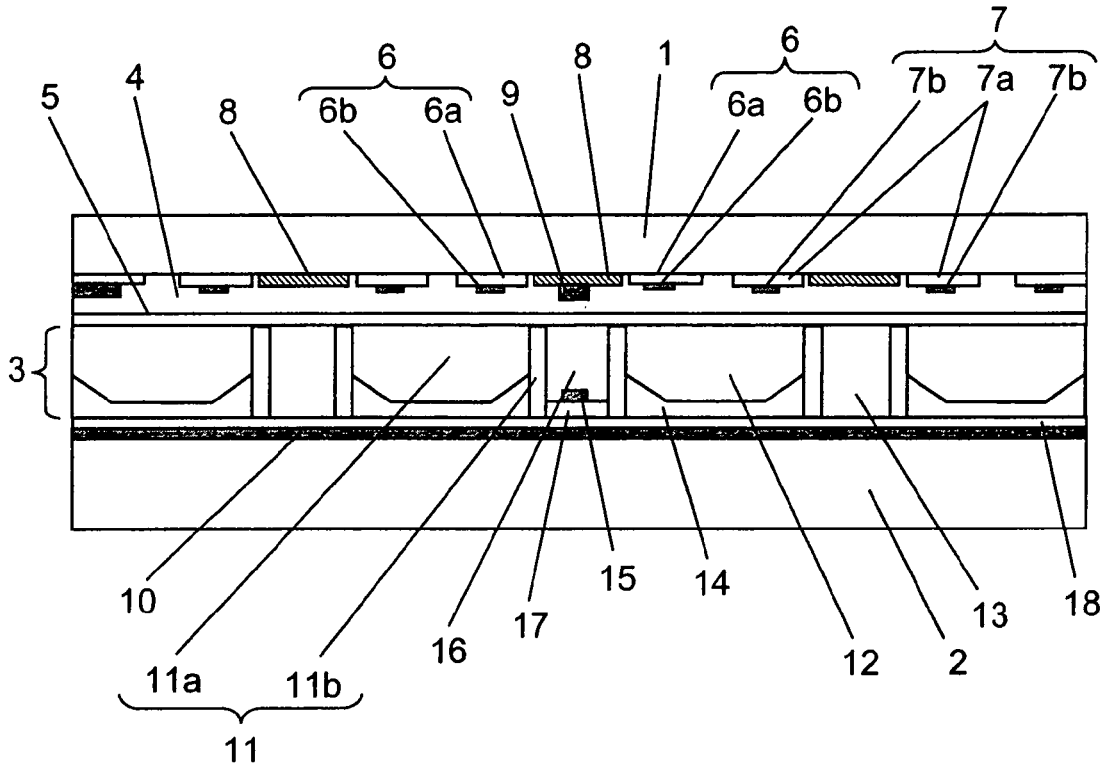
FIG. 5 is a cross sectional view showing a PDP according to a second embodiment of the present invention.
Figure 6:
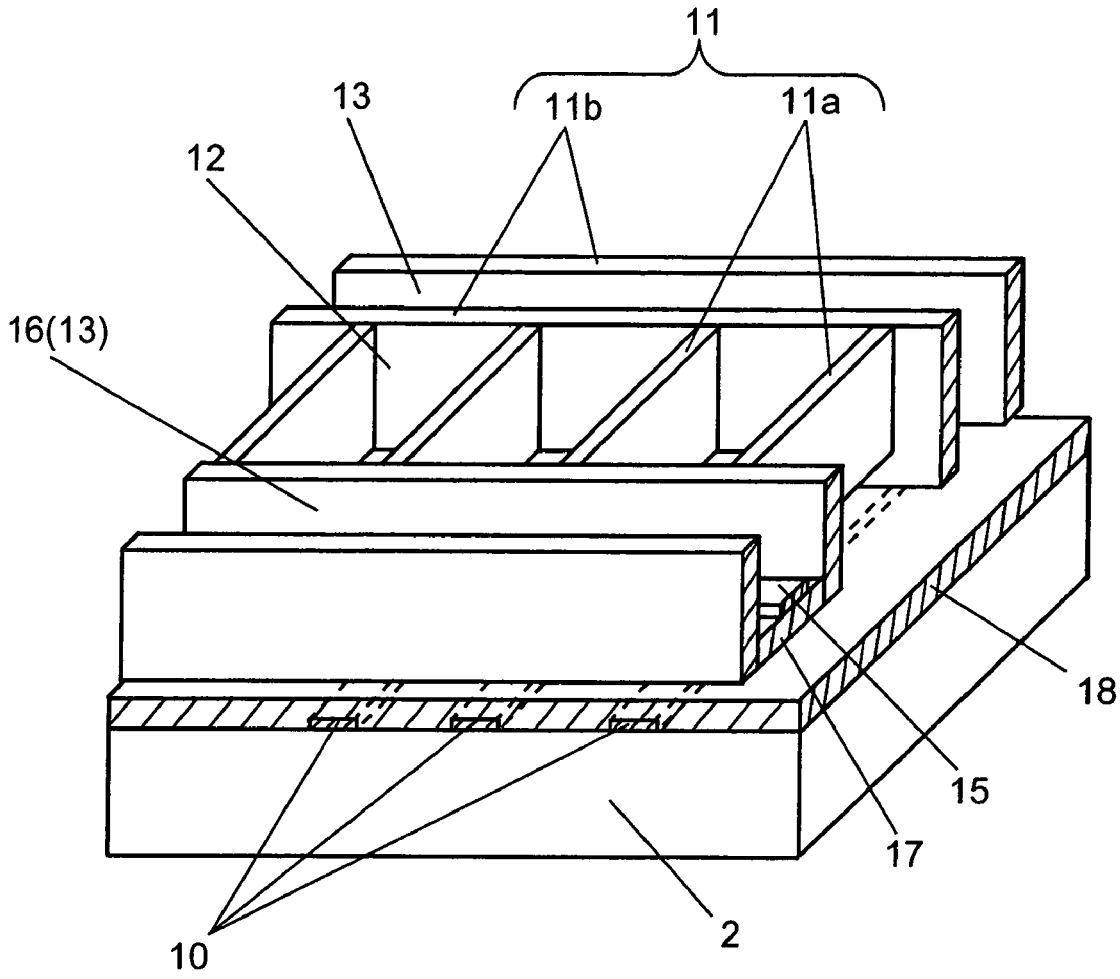
FIG. 6 is a schematic perspective view showing a back substrate side of the PDP according to the second embodiment of the present invention.

FIG. 5 is a cross sectional view showing a PDP according to a second embodiment of the present invention, and FIG. 6 is a schematic perspective view showing a back substrate side which is a second substrate side of the PDP according to the second embodiment.

As shown in FIGS. 5 and 6, the second embodiment has the same fundamental structure as the first embodiment shown in FIG. 1 and the same components are referred to with the same reference marks. The second embodiment differs from the first embodiment in the structure of back substrate 2. To be more specific, in the second embodiment, data electrodes 10 provided on back substrate 2 are covered with underlying dielectric layer 18. Barrier ribs 11 are formed on underlying dielectric layer 18, and priming discharge cells 16 and main discharge cells 12 are formed by being partitioned by barrier ribs 11. Therefore, in priming discharge cells 16, dielectric layer 17 is formed above underlying dielectric layer 18, and priming electrodes 15 are provided on dielectric layer 17.

Providing underlying dielectric layer 18 in this manner has advantages of increasing the reflection effect of underlying dielectric layer 18 so as to improve brightness, and of reducing the reaction between phosphor layers 14 and data electrodes 10 so as to improve the durability. In the second embodiment, in addition to the effects mentioned in the first embodiment, it becomes possible to reduce the height of the discharge spaces in priming discharge cells 16, as well as to secure the isolation voltage between data electrodes 10 and priming electrodes 15. As a result, the priming discharge can be generated securely and stably, thereby achieving a structure with a minor discharge delay which is suitable for a PDP with high definition.

As shown in FIGS. 3 and 6, in the first and second embodiments, priming discharge cells 16 and gap parts 13 are each formed into a rectangular space only by two lateral rib parts 11*b* of barrier ribs 11; however, similar to main discharge cells 12, longitudinal rib parts 11*a* may be provided.

Third Exemplary Embodiment

Figure 7:
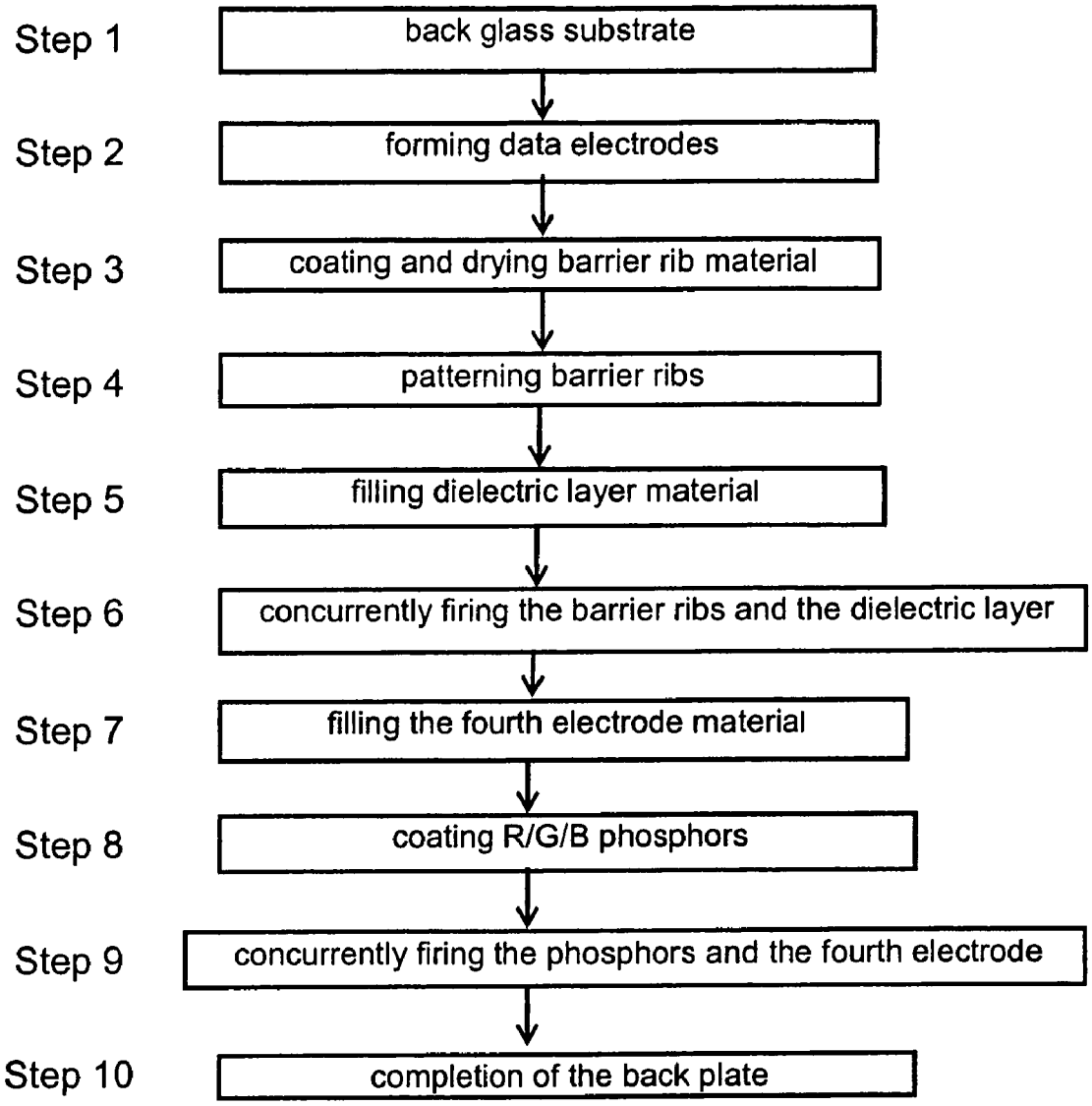
FIG. 7 is a flowchart showing a manufacturing process of a back substrate of a PDP according to a third embodiment of the present invention.
Figure 8:
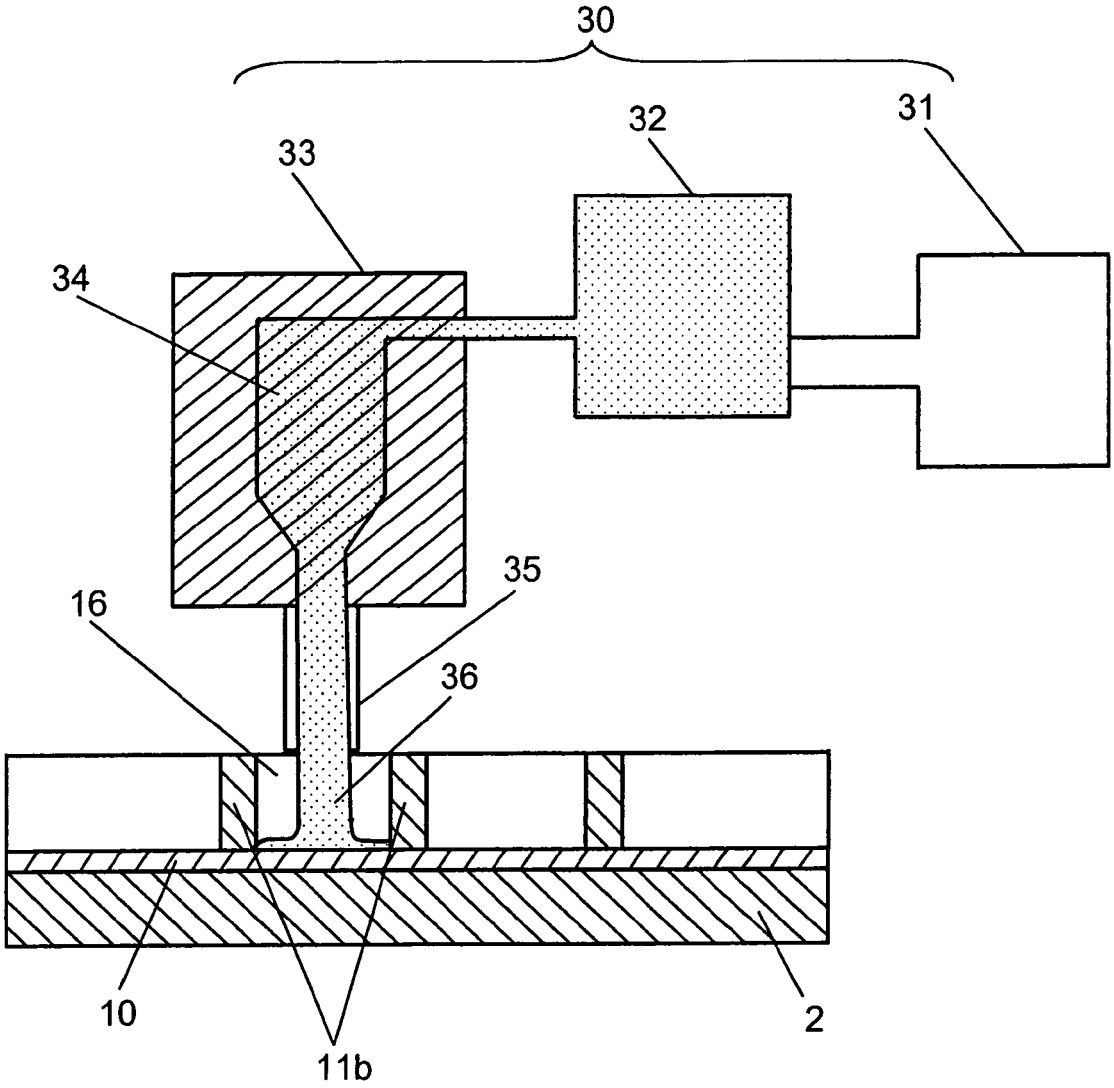
FIG. 8 is a schematic diagram of a filler and coater for a dielectric member and priming electrodes according to the third embodiment of the present invention.

FIG. 7 is a flowchart showing a process of manufacturing a back substrate of a PDP according to a third embodiment of the present invention. FIG. 8 is a schematic diagram of a filler and coater for forming a dielectric member and priming electrodes.

As shown in FIG. 7, in step 1 a back glass substrate which is back substrate 2 is prepared, and in step 2 data electrodes 10 are formed. The manufacture of data electrodes 10 includes a firing and solidification process. In step 3 barrier rib material for barrier ribs 11 such as photosensitive material is coated and dried. Later, in step 4 patterns for longitudinal rib parts 11*a* and lateral rib parts 11*b* which constitute the spaces for main discharge cells 12, the spaces for priming discharge cells 16 and the spaces for gap parts 13 are formed by using a photo process or the like. In this case, barrier ribs 11 have not yet undergone firing and solidification.

Next, of the spaces partitioned by barrier ribs 11 that have been patterned, priming discharge cells 16 are filled with a prescribed amount of dielectric layer material for forming dielectric layer 17. Then, in step 6 barrier ribs 11 patterned in step 4 and dielectric layer 17 filled into priming discharge cells 16 in step 5 concurrently undergo firing and solidification so as to form barrier ribs 11 and dielectric layer 17. In step 7 conductive material which is priming electrode material is filled onto dielectric layer 17 in priming discharge cells 16. In step 8 main discharge cells 12 are coated and filled with phosphor layers 14 for red, green and blue, and later, these phosphors and the priming electrode material filled into priming discharge cells 16 in step 7 concurrently undergo firing and solidification. Through the aforementioned processes, back substrate 2 is complete.

Barrier ribs 11 and dielectric layer 17, and priming electrodes 15 and phosphor layers 14 are concurrently sintered; however, they may be sintered separately. Furthermore, although phosphor layers 14 are coated in main discharge cells 12, they may be coated in priming discharge cells 16 or in gap parts 13.

A method for forming dielectric layer 17 and priming electrodes 15 in priming discharge cells 16 will be described as follows with reference to FIG. 8.

The filler and coater shown in FIG. 8 is formed of components having the common fundamental structure both for filling the dielectric material and for filling priming electrode material, and has a specification suitable for the respective material. And the following is a description of a method for forming dielectric layer 17 by filling dielectric material into priming discharge cells 16. Filler main body 30 includes server 31, pressurizing pump 32 and header 33, and dielectric paste 36 supplied from server 31 for storing dielectric paste is fed to header 33 by being pressurized by pressurizing pump 32.

Header 33 is provided with paste room 34 and nozzle 35, and dielectric paste 36 fed to paste room 34 by being pressurized is designed to be continuously discharged through nozzle 35. The bore of nozzle 35 is preferably 30 μm or larger to prevent clogging up and shorter than spacing W (about 120 to 200 μm) between barrier ribs 11 to prevent spilling outside barrier ribs 11 when coated, so that the bore is usually set to 30 to 130 μm.

Header 33 is structured to be driven straight by an unillustrated header scan mechanism, and scanning header 33 and discharging dielectric paste 36 continuously through nozzle 35 at the same time form data electrodes 10. Consequently, dielectric paste 36 is uniformly filled, in the longitudinal direction orthogonal to data electrodes 10, into the trenches between lateral rib parts 11*b* formed on back substrate 2 on which priming discharge cells 16 are formed by lateral rib parts 11*b* of barrier ribs 11. The viscosity of dielectric paste 36 used here is kept in a range of 1500 to 30000 centipores (cP) at 25° C.

Server 31 is provided with an unillustrated stirrer operated for preventing sediment of particles in dielectric paste 36. Header 33 is integrally formed including paste room 34 and nozzle 35 by applying a mechanical machining process and an electric discharge machining process to metal material.

The filling of dielectric paste 36 into the spaces forming priming discharge cells 16 by continuously discharging dielectric paste 36 through nozzle 35 can form dielectric layer 17 in priming discharge cells 16 at a lower cost and higher yields than cases using other manufacturing processes such as screen printing. The thickness of dielectric layer 17 can be changed in accordance with the paste viscosity or the scan speed of nozzle 35, thereby being able to correspond to specification change in the PDP. Although a single nozzle is used as nozzle 35 in this description, a multi-nozzle may be used in the actual PDP manufacturing process in order to reduce tact time.

In the aforementioned description, a method for filling the material of dielectric layer 17 into priming discharge cells 16 has been described; however, it is obvious that priming electrodes 15 can be formed by coating material paste thereof with the same device onto dielectric layer 17 thus formed, thereby obtaining the same effects as mentioned above.

Figure 9:
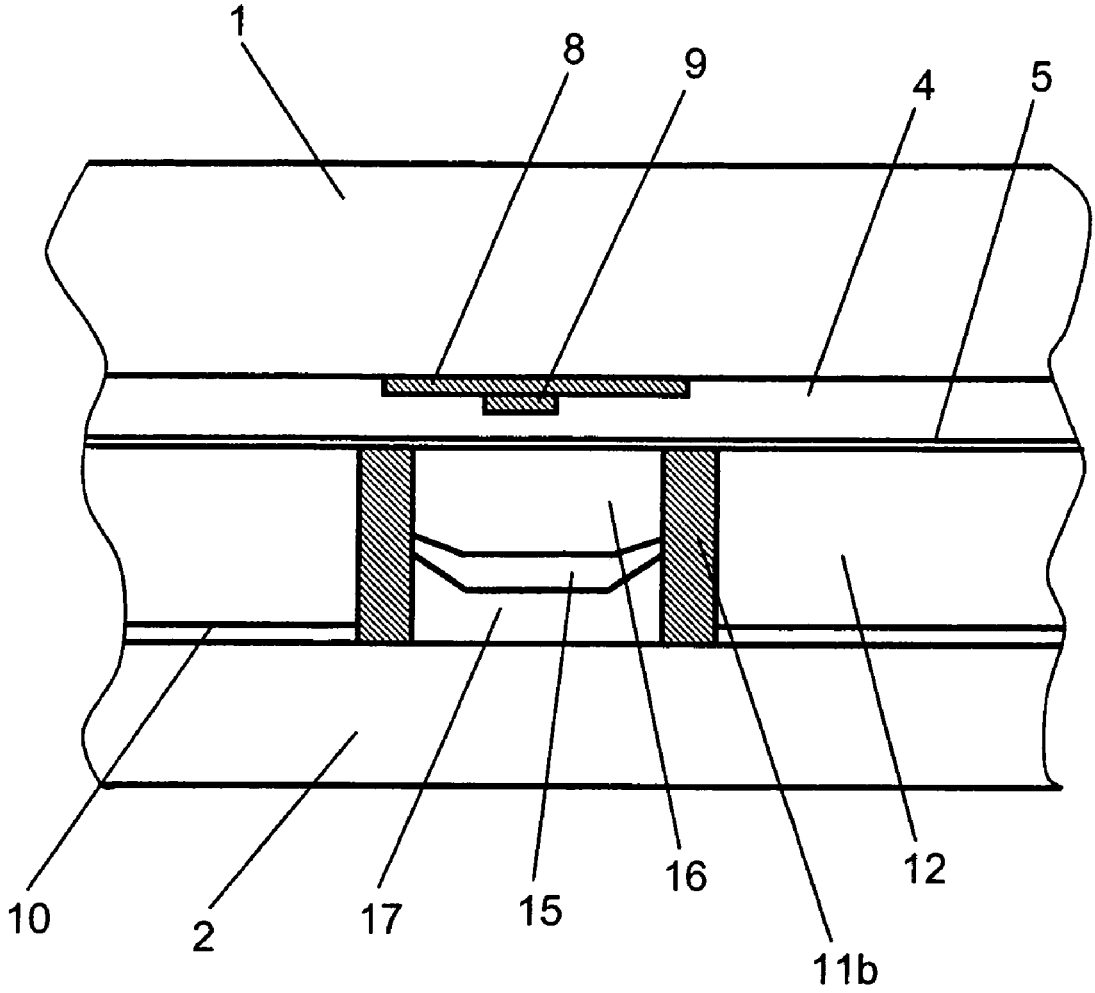
FIG. 9 is an enlarged cross sectional view of the main part of a PDP manufactured by a manufacturing method according to the third embodiment of the present invention.

FIG. 9 is an enlarged cross sectional view of one of priming discharge cells 16 formed by the aforementioned method. As shown in FIG. 9, dielectric layer 17 and priming electrode 15 formed in priming discharge cell 16 each have a meniscus shape on the side surfaces of lateral rib parts 11*b* because of the filling of the paste. Although priming electrode 15 is shaped to cover the whole top surface of dielectric layer 17, this shape can be varied by adjusting the bore of nozzle 35 and the paste viscosity.

INDUSTRIAL APPLICABILITY

A plasma display panel of the present invention has only a minor delay in discharge during the addressing so as to have excellent addressing properties compatible with high definition. Consequently, this plasma display panel is useful for a wall-hung TV, a large-size monitor, and the like.

The invention claimed is:

1. A plasma display panel, comprising:

a scan electrode and a sustain electrode parallel with each other on a front substrate;

a data electrode on a back substrate positioned orthogonally to the scan electrode and the sustain electrode, the back substrate facing the front substrate with a discharge space therebetween;

and a first discharge space and a second discharge space between the front substrate and the back substrate partitioned apart by a barrier rib, wherein a main discharge cell for performing a discharge with the scan electrode, the sustain electrode and the data electrode is in the first discharge space, a dielectric layer is on the back substrate in the second discharge space covering the data electrode, a priming electrode, independent of the data electrode, is on the dielectric layer so that the priming electrode is parallel to the scan electrode and the sustain electrode, and a priming discharge cell for performing a discharge with the scan electrode and the priming electrode is in the second discharge space, with different voltage signals applied to the priming electrode and the data electrode.

2. The plasma display panel according to claim 1, wherein the barrier rib is a longitudinal rib part extending in the direction orthogonal to the scan electrode and the sustain electrode, and a lateral rib part forming a gap part of continuous groove shape parallel with the scan electrode and the sustain electrode, and the gap part forms the second discharge space.

3. A method for manufacturing a plasma display panel, comprising:

forming a main discharge cell in a first discharge space, the main discharge cell comprising:

a scan electrode and a sustain electrode parallel with each other on a front substrate;

a data electrode on a back substrate positioned orthogonally to the scan electrode and the sustain electrode, the back substrate facing the front substrate with a discharge space therebetween; and the first discharge space and a second discharge space are between the front substrate and the back substrate partitioned apart by a barrier rib, and the main discharge cell for performing a discharge with the scan electrode, the sustain electrode and the data electrode;

forming a dielectric layer on the back substrate in the second discharge space covering the data electrode;

forming a priming electrode, independent of the data electrode, on the dielectric layer parallel to the scan electrode and the sustain electrode, with different voltage signals applied to the priming electrode and the data electrode; and forming a priming discharge cell in the second discharge space, the priming discharge cell performing a discharge with the priming electrode and the scan electrode, forming the second discharge space comprising:

forming the dielectric layer continuously in a longitudinal direction orthogonal at least to the data electrode; and forming the priming electrode continuous on the dielectric layer.

4. The method for manufacturing the plasma display panel according to claim 3, wherein forming the dielectric layer comprises filling dielectric paste into the second discharge space by discharging the dielectric paste at least through a nozzle.

5. The method for manufacturing the plasma display panel according to claim 4 further comprising continuously filling the dielectric layer after the barrier rib is patterned on the back substrate.

6. The method for manufacturing the plasma display panel according to claim 5, wherein the barrier rib and the dielectric layer concurrently undergo firing and solidification.

7. The method for manufacturing the plasma display panel according to claim 3, wherein forming the priming electrode comprises filling electrode material paste into the second discharge space by discharging the electrode material paste at least through a nozzle.

* * * * *